US008222977B2

(12) United States Patent
Oyama et al.

(10) Patent No.: US 8,222,977 B2
(45) Date of Patent: Jul. 17, 2012

(54) METAL PLATE FOR PREVENTING RADIOWAVE LEAKAGE THROUGH AN APERTURE IN A WAVEGUIDE BODY

(75) Inventors: Takayuki Oyama, Minato-ku (JP); Naotsugu Watanabe, Minato-ku (JP)

(73) Assignee: NEC Corporation, Tokyo (JP)

( * ) Notice: Subject to any disclaimer, the term of this patent is extended or adjusted under 35 U.S.C. 154(b) by 206 days.

(21) Appl. No.: 12/302,213

(22) PCT Filed: Mar. 5, 2008

(86) PCT No.: PCT/JP2008/053915

§ 371 (c)(1), (2), (4) Date: Nov. 24, 2008

(87) PCT Pub. No.: WO2008/108388

PCT Pub. Date: Sep. 12, 2008

(65) Prior Publication Data

US 2011/0205000 A1 Aug. 25, 2011

(30) Foreign Application Priority Data

Mar. 5, 2007 (JP) ..... 2007-054560

(51) Int. Cl.
*H01P 1/04* (2006.01)
*H01P 5/04* (2006.01)

(52) U.S. Cl. ..... 333/254; 333/34

(58) Field of Classification Search ..... 333/254, 333/248, 34, 33
See application file for complete search history.

(56) References Cited

U.S. PATENT DOCUMENTS

| | | | | |
|---|---|---|---|---|
| 2,930,995 | A | 3/1960 | Korb | |
| 3,125,731 | A | 3/1964 | Anderson | |
| 3,219,747 | A * | 11/1965 | McAdams | 174/350 |
| 3,806,837 | A | 4/1974 | Carr et al. | |
| 5,138,289 | A * | 8/1992 | McGrath | 333/253 |
| 5,384,557 | A | 1/1995 | Yoshida et al. | |
| 2010/0321136 | A1 * | 12/2010 | Ligander et al. | 333/254 |

FOREIGN PATENT DOCUMENTS

| | | | |
|---|---|---|---|
| JP | 53-10239 | A | 1/1978 |
| JP | 60-004301 | A | 1/1985 |
| JP | 3750856 | B2 | 12/2005 |

OTHER PUBLICATIONS

Supplementary European Search Report, dated Sep. 26, 2011, issued in corresponding European Application No. 08721335.

* cited by examiner

*Primary Examiner* — Benny Lee
(74) *Attorney, Agent, or Firm* — Sughrue Mion, PLLC

(57) ABSTRACT

A waveguide circuit is provided, in which fixing a metal cover to a waveguide body with screws can prevent radiowave leakage suitably without any application of the conductive adhesive, solder and braze as a material for the radiowave leakage prevention. A metal plate is provided at the end of an aperture of a waveguide body in a radiowave traveling direction and overlaps with the end of a metal cover.

11 Claims, 5 Drawing Sheets

METAL PLATE FOR PREVENTING RADIOWAVE LEAKAGE THROUGH AN APERTURE IN A WAVEGUIDE BODY

TECHNICAL FIELD (An explanation of the related application) The present application is based on the priority of Japanese patent application No. 2007-054560 (filed on Mar. 5, 2007). The entire disclosure of the prior application is regarded as incorporated therein by reference thereto.

The present invention relates to a waveguide circuit having functions of transmission of a radio wave as well as a distributor and coupler, i.e., a functional waveguide.

RELATED ART

FIG. 5 shows an example of a waveguide circuit according to a background art. In the waveguide circuit according to the background art, an opening of a waveguide body 101 which is a metal case is covered with a metal cover 102. A radiowave leakage preventing material 103, such as conductive adhesive, solder or braze, is provided on the outside in order to prevent the radiowave from leaking between an edge of the metal cover and an edge of the opening in a radiowave traveling direction (in the longitudinal direction of the waveguide body 101).

A waveguide 104 in which the opening of the waveguide body 101 which is covered with the metal cover 102 is connected with a connecting waveguide 105 by connecting flanges 104*a*, 105*a* with each other.

Patent document 1 (JP-S53-10239U) and Patent document 2 (JP3750856B) disclose a combination of a waveguide body and a metal cover.

Patent document 1: JP-S53-10239U

Patent document 2: JP3750856B

SUMMARY OF THE INVENTION

Problems to be Solved by the Invention

Disclosures of Patent documents 1-2 are regarded as incorporated herein by reference thereto. An analysis on the related art will be provided below based on the present invention. Application of the radiowave leakage preventing material 103 as illustrated in FIG. 5 requires too much time.

Patent documents 1-2 provide no consideration for the prevention of the radiowave leakage in the radiowave traveling direction.

It is an object of the present invention to provide a waveguide circuit which can achieve the prevention of the radiowave leakage suitably by merely securing a metal cover on a waveguide body without any application of the conductive adhesive, solder or braze as a material for the radiowave leakage prevention.

Means to Solve the Problems

A waveguide circuit of the present invention comprises a waveguide body having an opening (aperture) and a metal cover covering the opening, a metal plate being provided at an end of the opening in a radio-wave traveling direction and overlapping with an end of the metal cover.

Meritorious Effects of the Invention

According to the present invention, the metal plate disposed on the waveguide body can prevent the radiowave leakage by merely securing the metal cover on the waveguide body with, for example, a screw without the application of the conductive adhesive, solder or braze as a material for the radiowave leakage prevention.

EXPLANATIONS OF SYMBOLS

Figure 1:
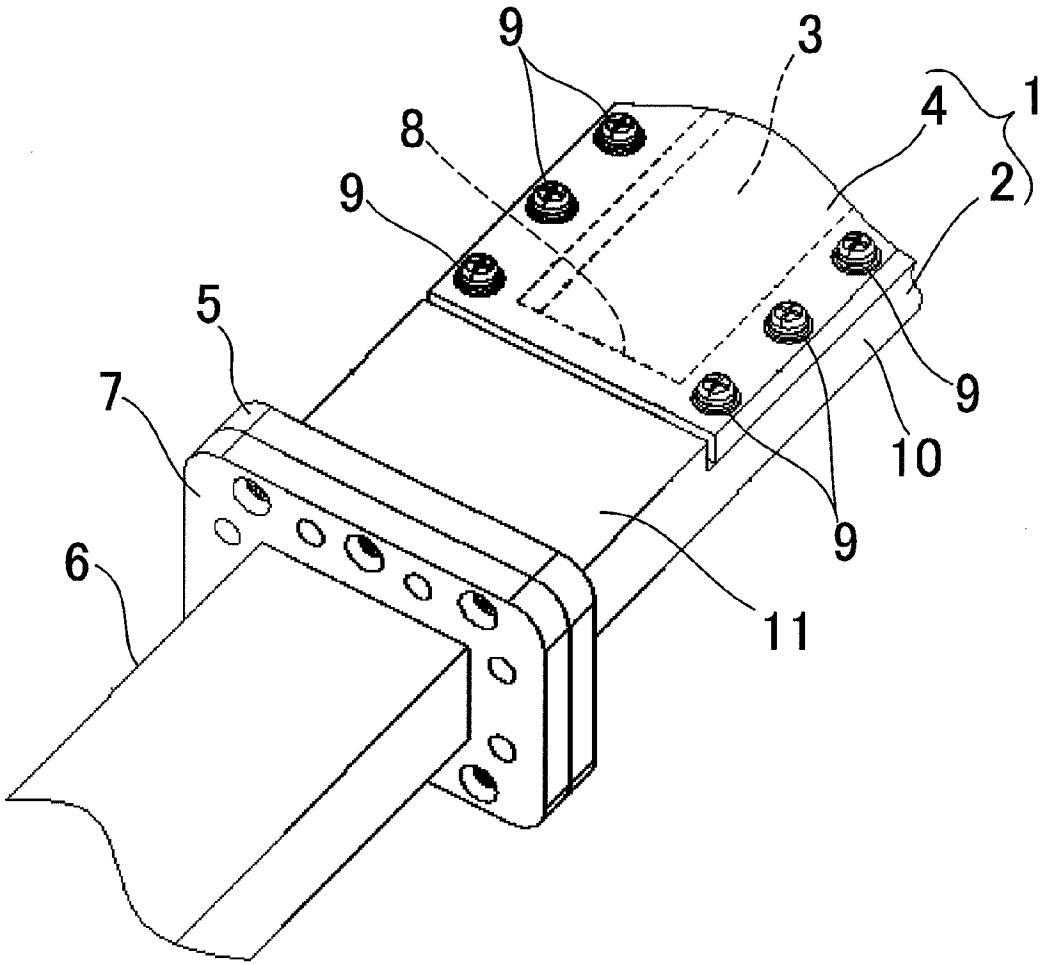
FIG. 1 is a perspective view in common with exemplary embodiments 1-3 of the present invention.

1 Waveguide
2 Waveguide body
3 Aperture
4 Metal cover
5 Flange
6 Connecting waveguide
7 Flange
8 Metal plate
9 Screw
10 Waveguide portion
11 Matching waveguide portion

PREFERRED MODES FOR CARRYING OUT THE INVENTION

According to a first aspect, in a waveguide circuit in which an aperture of a waveguide body is covered with a metal cover, a metal plate is provided at an end of the aperture (or surface) of the wave guide body in a radiowave traveling direction and overlaps with an end of the metal cover.

In a preferred exemplary embodiment of the first aspect, the metal plate is disposed integral with the waveguide body at the aperture. According to this exemplary embodiment, the radiowave leakage can be suitably prevented since the metal plate is formed in unison with the waveguide body.

In a preferred exemplary embodiment of the first aspect, the aperture of the waveguide body extends elongated in the radiowave traveling direction. The metal cover is secured onto both lateral sides of the aperture by screwing. According to this exemplary embodiment, the waveguide circuit can be constructed in a short time by merely securing the metal cover onto the lateral sides of the aperture with screws.

In a preferred exemplary embodiment of the first aspect, the waveguide circuit comprises the waveguide body as described above and a connecting waveguide connecting with the waveguide body by abutting their flanges with each other. In the waveguide circuit, a part of the waveguide body from the metal plate to the flange serves (acts) as a waveguide matching portion which matches impedances between a waveguide portion, which is a part of the waveguide body forming the aperture (or surface), and the connecting waveguide. According to this exemplary embodiment, the impedance matching with the connecting waveguide can be achieved by the part of the waveguide body extending from the metal plate to the flange.

In a preferred exemplary embodiment of the first aspect and, especially, a first concrete example of the waveguide circuit having the above connection, when the aperture of the waveguide body faces upward, an upper inner surface of the matching waveguide portion is lower than a lower surface of the metal cover and an upper inner surface of the connecting waveguide, so that the inner surfaces of the waveguide portion, matching waveguide portion and connecting waveguide are at the same height as (i.e., flush with) one another. According to this exemplary embodiment, there is no step difference since the bottom inner surfaces of the waveguide portion, matching waveguide portion and connecting waveguide since they are flush with one another. Therefore, the efficiency in the manufacturing becomes improved because a burring operation for removing burs caused by the step difference is unnecessary.

In a preferred exemplary embodiment of the first aspect and, especially, a second concrete example, when the aperture of the waveguide body faces upward, the upper inner surface of the matching waveguide portion is lower than the lower surface of the metal cover and the upper inner surface of the connecting waveguide, the bottom inner surface of the matching waveguide portion being lower than the bottom inner surface of the waveguide portion, the bottom inner surface of the connecting waveguide is further lower than the inner bottom surface of the matching waveguide portion. According to this exemplary embodiment, if the impedances of the waveguide portion, matching waveguide portion and connecting waveguide portion are the same as one another, the length of the matching waveguide portion may be selected as required, which results in an improved adaptability in the structure (designing) of the waveguide portion and connecting waveguide.

In a preferred exemplary embodiment of the first aspect and, especially, a third concrete example, when the aperture of the waveguide body faces upward, the upper inner surface of the matching waveguide portion is lower than the lower surface of the metal cover and the upper inner surface of the connecting waveguide, the bottom inner surface of the matching waveguide portion being lower than the bottom inner surface of the waveguide portion and the bottom inner surface of the connecting waveguide. According to this exemplary embodiment, the property of VSWR (Voltage Standing Wave Ratio) which is a ratio of the maximum value of a voltage standing wave to the minimum value is improved under the condition that the impedances of the waveguide portion and connecting waveguide are the same.

Next, examples of the present invention will be explained in detail referring to drawings, where like features are denoted by the same reference numbers which may not be described in detail in all drawing figures in which they appear.

EXAMPLES

Figure 2:
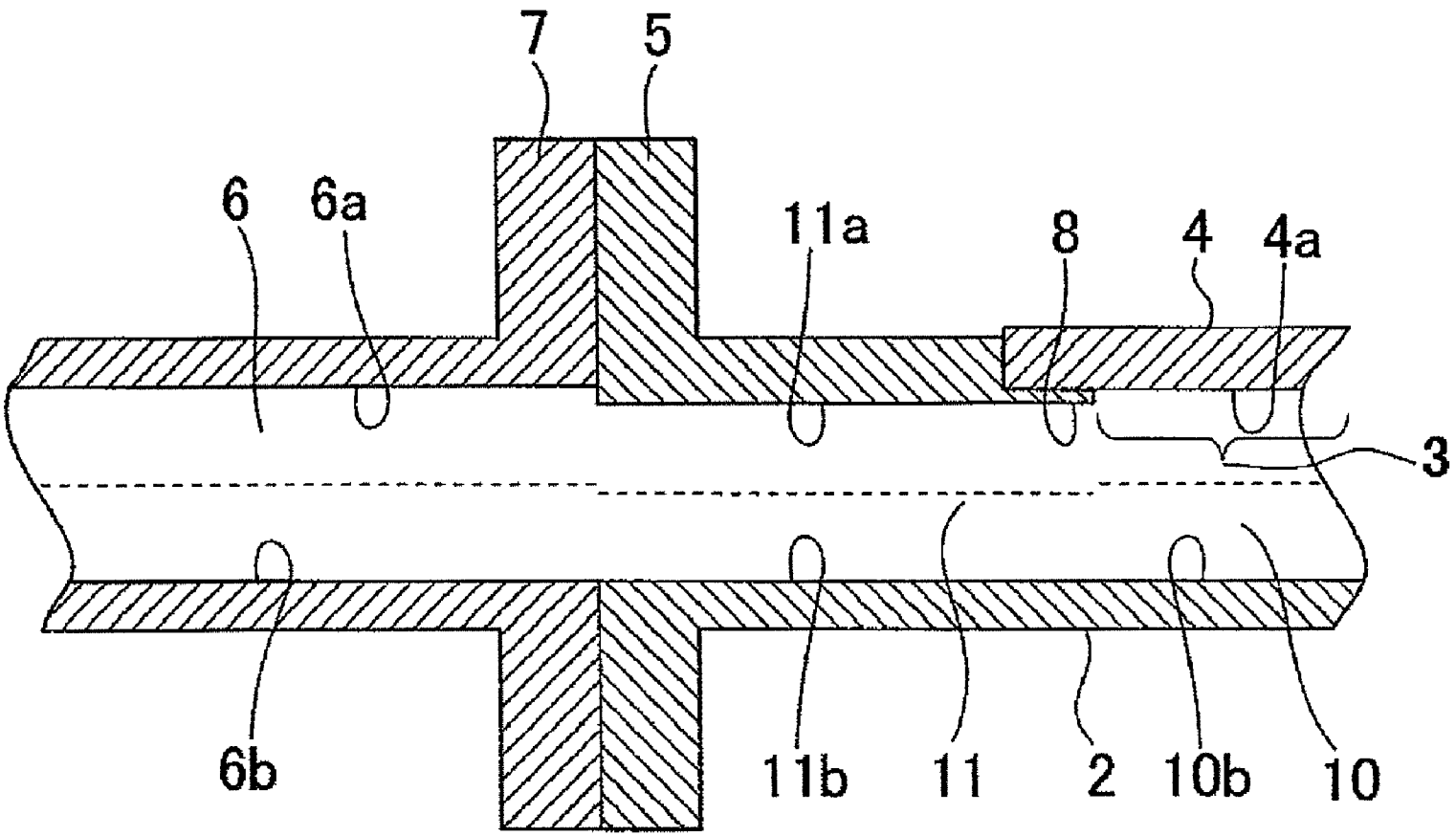
FIG. 2 is a cross sectional view of example 1.

FIG. 1 shows a perspective view of an external appearance in common with examples 1-3 of the present invention. FIG. 2 shows a cross sectional view in example 1.

In FIG. 1, a waveguide 1 comprises a waveguide body 2 which is a metal case in the shape of a rectangular tube, and a metal plate cover 4 covering an aperture 3 on the top surface of the waveguide body. The waveguide body 2 has a flange 5 as a part at an end. The flange 5 is connected with a flange 7 of another waveguide, which is a connecting waveguide 6, to connect the waveguide 1 with the connecting waveguide 6.

The aperture 3 of the waveguide body 2 extends up to a position near (upstream) the flange 5 in the radiowave traveling direction (i.e., in the longitudinal direction of the waveguide body 2). A metal plate 8 is formed integral with the waveguide body 2 at the end of the aperture 3.

The end of the metal cover 4 is disposed as to be overlapping with the metal plate 8. The metal cover 4 is secured on to the waveguide body 2 with screws 9 at both lateral sides of the aperture 3 entirely, so as to cover up to the necessary peripheral region around the aperture 3, extending beyond the opening edge of the aperture 3.

In the waveguide 1 assembled by the waveguide body 2 and the metal cover 4 in the above manner, the right most portion in FIG. 2, which is covered with the metal cover 4, is regarded as an inherent waveguide portion 10, whereby a portion ranging from the metal plate 8 to the flange 5 constitutes a matching waveguide portion 11 which matches impedances with the connecting waveguide 6.

Relating to the aperture 3 of the waveguide 1 as formulated above, a structure in which the end of the metal cover 4 overlaps the metal plate 8 can prevent the radiowave from leaking in the radiowave traveling direction. If the radiowave leaks outward, an unnecessary radiant wave and increase in transmission loss will occur.

Also, by designing the distance between the waveguide portion 10 and the connecting waveguide 6 suitably, the impedance matching can be achieved between the waveguide portion 10 and the connecting waveguide 6. If the impedance matching is not achieved, the increase in the transmission loss and reflection of an RF signal back to the input side will occur. Thus, the level of the transmitted RF signal will be reduced.

In the cross sectional view as illustrated in FIG. 2, a top wall of the waveguide body 2 at the end of the aperture 3 is made partially thinner so as to form a step difference (an L-shape), thus providing the metal plate 8. In example 1, an upper inner top surface 11*a* of the matching waveguide portion 11 is lower than a lower surface 4*a* of the metal cover 4 and an upper inner surface 6*a* of the connecting waveguide 6. The bottom surfaces 10*b*, 11*b* and 6*b*, respectively corresponding to the insides of the waveguide portion 10, matching waveguide portion 11 and connecting waveguide 6, are at the same level so as to be flush with one another. From the point of view of the height of each central line, as illustrated by broken lines, the central line of the waveguide portion 10 is at the same height as the central line of the connecting waveguide 6, while the central line of the matching waveguide portion 11 is lower than these lines.

According to the formulation of example 1, if an impedance of the connecting waveguide 6 is the same as an impedance of the waveguide portion 10, impedance matching can become satisfactory when a length of the matching waveguide portion 11 is about half of a wavelength of the radiowave traveling in the waveguide. If an impedance of the connecting waveguide 6 is different from an impedance of the waveguide portion 10, impedance matching can become satisfactory when the length of the matching waveguide portion 11 is about quarter of the wavelength of the radiowave traveling in the waveguide.

Since the lower (bottom) inner surfaces 10*b*, 11*b* and 6*b*, respectively corresponding to the waveguide portion 10, the matching waveguide portion 11 and the connecting waveguide 6, are at the same height so as to be flush to one surface, a burring operation for removing burs caused by (forming) the step difference becomes unnecessary.

Example 2

Figure 3:
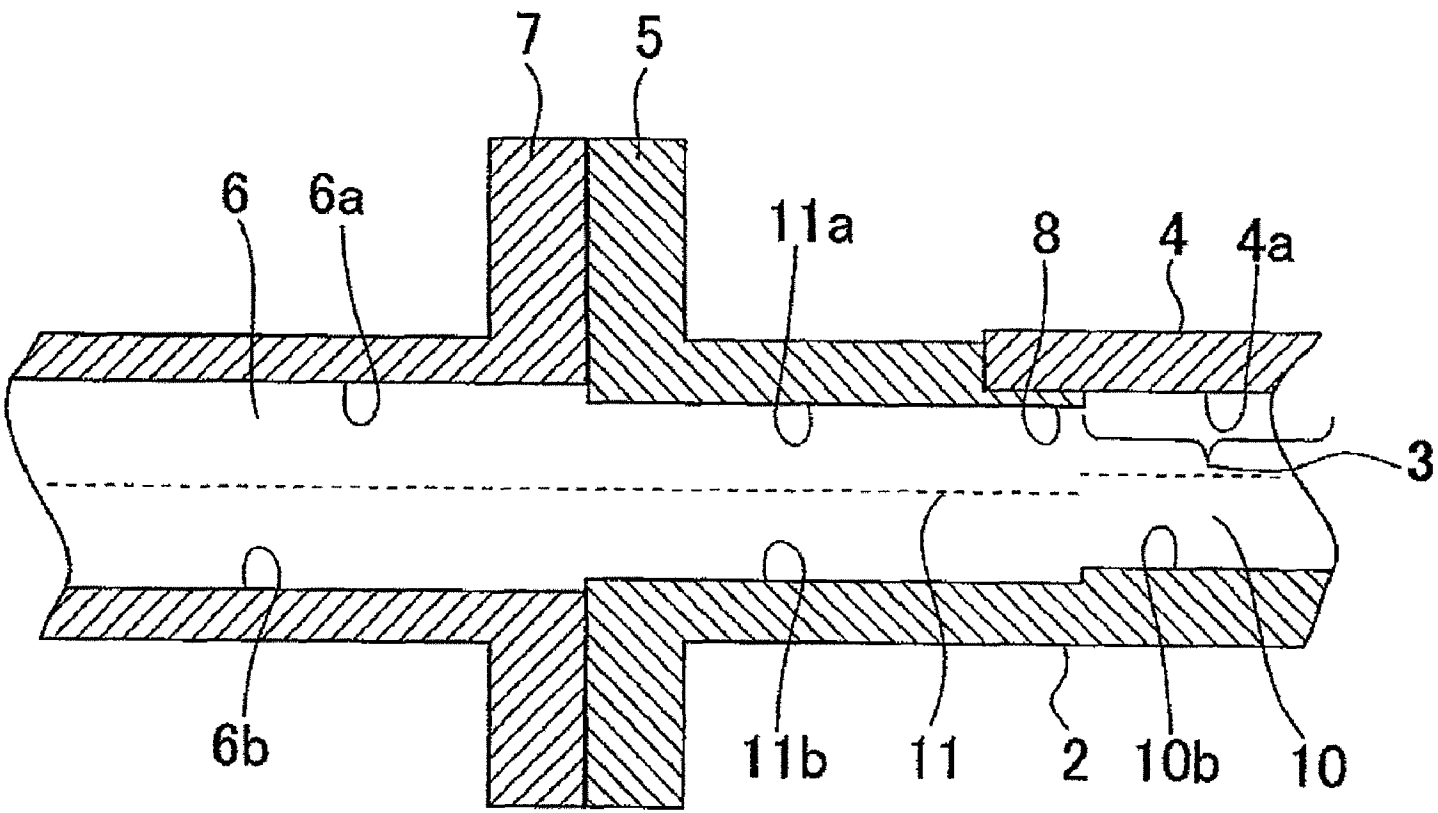
FIG. 3 is a cross sectional view of example 2.

FIG. 3 shows the cross sectional view of example 2. The following points are different from example 1.

The upper inner surface 11*a* of the matching waveguide portion 11 is lower than the lower surface 4*a* of the metal cover 4 and the upper inner surface 6*a* of the connecting waveguide 6. The bottom inner surface 11*b* of the matching waveguide portion 11 is lower than the bottom inner surface 10*b* of the waveguide portion 10. The bottom inner surface 6*b* of the connecting waveguide 6 is further lower than the bottom inner surface 11*b* of the matching waveguide portion 11. From the point of view of the heights of the central lines of the waveguide portion 10, matching waveguide portion 11 and connecting waveguide 6, the central line of the connecting waveguide 6 is at the same height as the central line of the matching waveguide portion 11, and the central line of the waveguide portion 10 is higher than these central lines.

According to example 2, if the impedances among the waveguide portion 10, matching waveguide portion 11 and connecting waveguide 6 become the same, since the length of the matching waveguide portion 11 can be designed as desired, the waveguide portion 10 and connecting waveguide 11 can be adapted easily, as far as the structure is concerned.

Example 3

Figure 4:
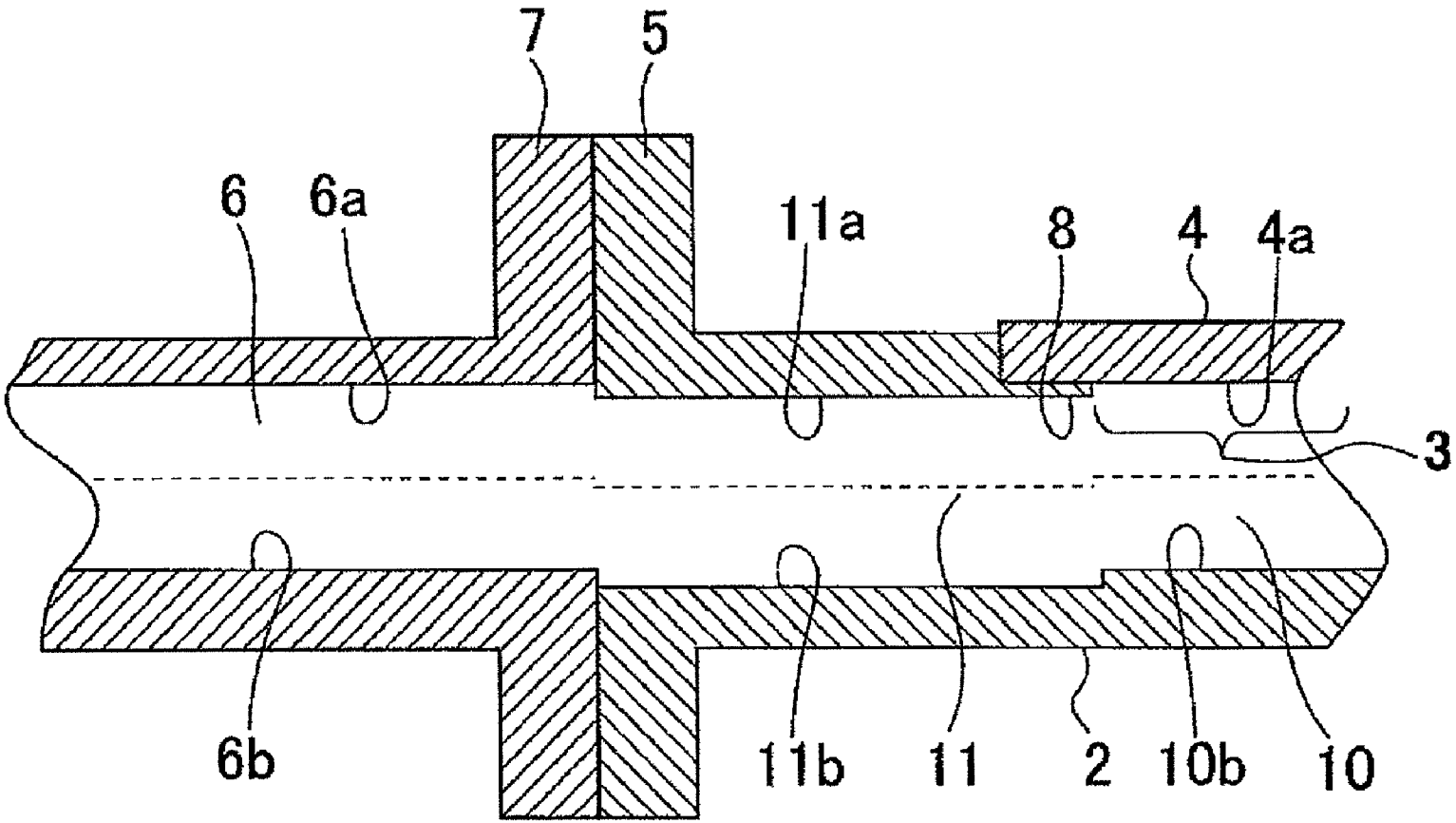
FIG. 4 is a cross sectional view of example 3.
Figure 5:
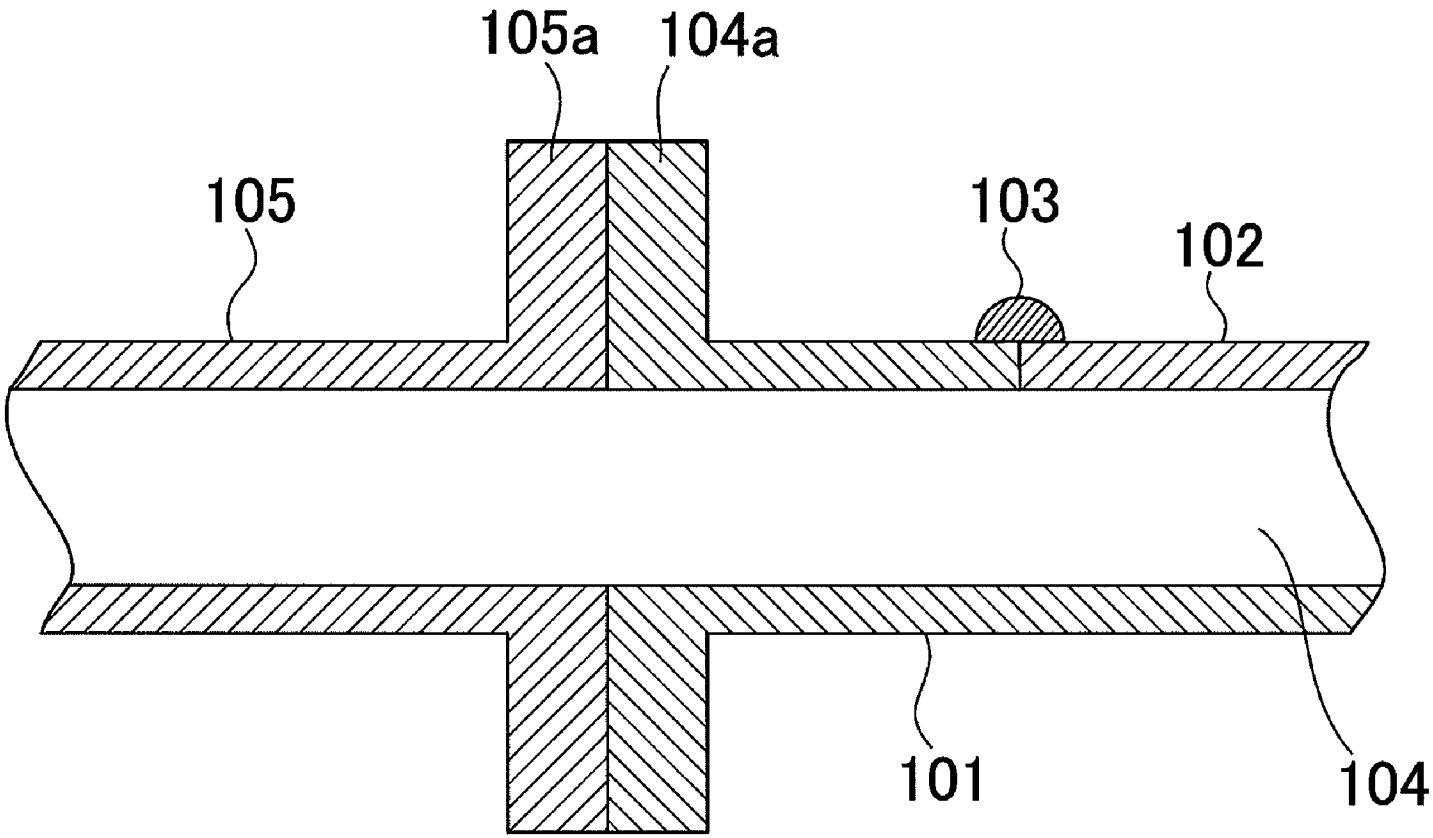
FIG. 5 RELATED ART
FIG. 5 is a cross sectional view of an example according to a background (related) art.

FIG. 4 shows the cross sectional view of example 3. The following points are different from example 1.

The upper inner surface 11*a* of the matching waveguide portion 11 is lower than the lower surface 4*a* of the metal cover 4 and the upper inner surface 6*a* of the connecting waveguide 6. The bottom inner surface 11*b* of the matching waveguide portion 11 is lower than of the bottom inner surface 10*b* of the waveguide portion 10 and bottom surface 6*b* of the inside of the connecting waveguide 6. From the point of view of the heights of the central lines among the waveguide portion 10, matching waveguide portion 11 and connecting waveguide 6, the central line of the waveguide portion 10 is at the same height as the central line of the connecting waveguide 6, whereas the central line of the matching waveguide portion 11 is lower than these central lines and than the case in example 1.

According to example 3, electric performance is better than examples 1-2. If the impedances of waveguide portion 10 and connecting waveguide 6 are the same, the VSWR properties are 1.03 or less in example 1, 1.02 or less in example 2, and 1.01 or less in example 3. The value of the example 3 is best.

The examples and examples are modifiable and adaptable based on the technical idea within the disclosure (including claims) of the present invention. The disclosed subject matters may be combined or selected within the claims of the present invention.

The invention claimed is:

1. A waveguide circuit comprising:

a waveguide body having an aperture provided therein, a metal cover covering said aperture, and a metal plate for preventing a radiowave leakage between an edge of said metal cover and an edge of said aperture in a radiowave traveling direction;

wherein said metal plate is provided at an end of said aperture in the radiowave traveling direction and overlaps with the end of said metal cover.

2. The waveguide circuit according to claim 1, wherein said metal plate is formed as a part of said waveguide body at said aperture.

3. The waveguide circuit according to claim 1, wherein said aperture of said waveguide body extends in the radiowave traveling direction, and the metal cover is secured with at least one screw at both lateral sides of said aperture.

4. The waveguide circuit according to claim 1, further comprising:

a connecting waveguide, having a flange, to connect with said waveguide body; wherein said waveguide body comprises a flange, the flange of said waveguide body is connected with the flange of said connecting waveguide to connect said waveguide body with said connecting waveguide; and a part of said waveguide body extending from said metal plate to the flange of said waveguide body is formed as a matching waveguide portion which matches impedances between a waveguide portion which is a part of forming said aperture of said waveguide body and said connecting waveguide.

5. The waveguide circuit according to claim 4, wherein said aperture of said waveguide body faces upward, and an upper inner surface of said matching waveguide portion is lower than a lower surface of said metal cover and an upper inner surface of said connecting waveguide, and bottom inner surfaces of said waveguide portion, said matching waveguide portion and said connecting waveguide are at the same height as one another.

6. The waveguide circuit according to claim 4, wherein said aperture of said waveguide body faces upward, and an upper inner surface of said matching waveguide portion is lower than a lower surface of said metal cover and an upper inner surface of said connecting waveguide, a bottom inner surface of said matching waveguide portion is lower than a bottom inner surface of said waveguide portion, and a bottom inner surface of said connecting waveguide is further lower than the bottom inner surface of said matching waveguide portion.

7. The waveguide circuit according to claim 4, wherein said aperture of said waveguide body faces upward, and an upper inner surface of said matching waveguide portion is lower than a lower inner surface of said metal cover and an upper inner surface of said connecting waveguide, and a bottom inner surface of said matching waveguide portion is lower than a bottom inner surface of said waveguide portion and a bottom inner surface of said connecting waveguide.

8. The waveguide circuit according to claim 2, wherein said waveguide body comprises a flange for connecting with a connecting waveguide, and a part of said waveguide body extending from said metal plate to the flange of said waveguide body is formed as a matching waveguide portion which matches impedances between a waveguide portion which is a part of forming said aperture of said waveguide body and said connecting waveguide.

9. The waveguide circuit according to claim 8, wherein said aperture of said waveguide body faces upward, and an upper inner surface of said matching waveguide portion is lower than a lower surface of said metal cover and an upper inner surface of said connecting waveguide, and bottom inner surfaces of said waveguide portion, said matching waveguide portion and said connecting waveguide are at the same height as one another.

10. The waveguide circuit according to claim 8, wherein said aperture of said waveguide body faces upward, and an upper inner surface of said matching waveguide portion is lower than a lower surface of said metal cover and an upper inner surface of said connecting waveguide, a bottom inner surface of said matching waveguide portion is lower than a bottom inner surface of said waveguide portion, and a bottom inner surface of said connecting waveguide is further lower than the bottom inner surface of said matching waveguide portion.

11. The waveguide circuit according to claim 8, wherein said aperture of said waveguide body faces upward, and an upper inner surface of said matching waveguide portion is lower than a lower inner surface of said metal cover and an upper inner surface of said connecting waveguide, and a bottom inner surface of said matching waveguide portion is lower than a bottom inner surface of said waveguide portion and a bottom inner surface of said connecting waveguide.

* * * * *